US012655605B2

(12) United States Patent
Kenno et al.

(10) Patent No.: US 12,655,605 B2
(45) Date of Patent: Jun. 16, 2026

(54) MULTI-TOOL CUTTING ASSEMBLY

(71) Applicant: KENNAMETAL INC., Latrobe, PA (US)

(72) Inventors: Brandon J. Kenno, Windber, PA (US); Thomas J. Long, II, Greensburg, PA (US); Eric P. Helsel, Spring, TX (US); James R. Geyer, Manns Choice, PA (US); Glenn J. Fowler, Carrolltown, PA (US); Arkadiusz Dlugosz, Sikorskiego (PL)

(73) Assignee: KENNAMETAL INC., Latrobe, PA (US)

( * ) Notice: Subject to any disclaimer, the term of this patent is extended or adjusted under 35 U.S.C. 154(b) by 369 days.

(21) Appl. No.: 18/361,368

(22) Filed: Jul. 28, 2023

(65) Prior Publication Data

US 2025/0034837 A1 Jan. 30, 2025

(51) Int. Cl.
*E02F 3/10* (2006.01)
*E02F 5/06* (2006.01)

(52) U.S. Cl.
CPC . *E02F 5/06* (2013.01); *E02F 3/10* (2013.01)

(58) Field of Classification Search
CPC ..... E02F 3/10; E02F 5/06
See application file for complete search history.

(56) References Cited

U.S. PATENT DOCUMENTS 1,404,835 A 1/1922 Christine
2,096,875 A 10/1937 Bertovich
2,742,439 A 4/1956 Hallett
2,810,567 A 10/1957 Kirkham
3,295,232 A 1/1967 Oglesby et al.
3,361,481 A 1/1968 Maddock
3,652,130 A 3/1972 Elders
3,663,063 A 5/1972 Johnmeyer, Sr.
3,746,396 A 7/1973 Radd
3,796,464 A 3/1974 Hansen et al.
4,244,625 A 1/1981 Turner et al.
(Continued)

FOREIGN PATENT DOCUMENTS

CN 106640067 A 5/2017
CN 107916931 A 4/2018
(Continued)

OTHER PUBLICATIONS

Kennam et al., "C87B—Blocks," 1 Page. Retrieved from the Internet:[URL:https://www.kennametal.com/us/en/products/p.c87b.1012275.html] [retrieved on Aug. 10, 2023].
(Continued)

*Primary Examiner* — Matthew R Buck
(74) *Attorney, Agent, or Firm* — Christopher J. Owens

(57) ABSTRACT

A cutting system includes a rotatable transport member, a plurality of tool holders, and a plurality of cutting tools. A plurality of tool holders is attached to the rotatable transport member. The plurality of tool holders is spaced apart along the rotatable transport member and configured to passively rotate relative to the rotatable transport member. The plurality of cutting tools is rotatably attached to each tool holder. Each of the cutting tools is configured to passively rotate around different axis than an axis around which the tool holder passively rotates.

21 Claims, 8 Drawing Sheets

(56) References Cited

U.S. PATENT DOCUMENTS

| | | | | |
|---|---|---|---|---|
| 4,448,269 | A | 5/1984 | Ishikawa et al. | |
| 5,338,102 | A | 8/1994 | Lent et al. | |
| 7,950,170 | B2 * | 5/2011 | Hall | E02F 9/2858 37/352 |
| 9,828,742 | B2 | 11/2017 | Hagenbuch | |
| 10,352,163 | B2 * | 7/2019 | Hagenbuch | E02F 3/088 |
| D940,767 | S | 1/2022 | Mahaffey, Jr. et al. | |
| 2008/0282584 | A1 | 11/2008 | Hall et al. | |
| 2009/0260264 | A1 | 10/2009 | Cooper et al. | |
| 2014/0339883 | A1 | 11/2014 | Burton et al. | |
| 2015/0218776 | A1 | 8/2015 | Hagenbuch | |
| 2016/0273183 | A1 * | 9/2016 | Cutler | E02F 3/143 |

FOREIGN PATENT DOCUMENTS

| | | | | |
|---|---|---|---|---|
| CN | 109236288 | A | 1/2019 | |
| DE | 102011014569 | A1 * | 9/2011 | E21C 35/197 |
| EP | 2597205 | A1 | 5/2013 | |
| WO | 211823 | | 12/2020 | |

OTHER PUBLICATIONS

Kennametal., "Rotating Tungsten Carbide Pick—22mm (.87 in) Shank," Smooth Retainer for any Bore-Plug Tip for Hard Cutting, Retrieved from the Internet:[https://www.kennametal.com/us/en/products/fam.rotating-tungsten-carbide-pick-22mm-87-in-shank.103506138.html] [retrieved on Aug. 10, 2023].

* cited by examiner

MULTI-TOOL CUTTING ASSEMBLY

FIELD OF THE DISCLOSURE

The disclosure relates to multi-tool cutting systems, cutting assemblies, and to methods of their use.

BACKGROUND

Multi-tool cutting systems and assemblies sometimes have issues with their cutting heads stalling during operation. Moreover, when one cutting insert requires replacement, the entire cutting head may need to be disassembled or replaced. This may be timely, costly, and inefficient.

An improved cutting system, cutting assembly, and method of their use is needed to reduce or eliminate one or more issues associated with existing multi-tool cutting systems, assemblies, and methods of use.

SUMMARY

In one embodiment, a cutting system includes a rotatable transport member, a plurality of tool holders, and a plurality of cutting tools. A plurality of tool holders is attached to the rotatable transport member. The plurality of tool holders is spaced apart along the rotatable transport member and configured to passively rotate relative to the rotatable transport member. The plurality of cutting tools is rotatably attached to each tool holder. Each of the cutting tools is configured to passively rotate around different axis than an axis around which the tool holder passively rotates.

In another embodiment, a cutting system includes a tool holder and a plurality of cutting tools. The tool holder includes a drum and an outwardly extending curved member disposed at an end of the drum. An end of the outwardly extending curved member includes a plurality of pockets spaced apart around the end of the outwardly extending curved member. The tool holder is configured to rotate around an axis. Each cutting tool includes a cutting insert, a tool body, and a retaining member. Each cutting insert is disposed in a bore of a respective tool body. Each tool body is disposed in a respective pocket of the end of the outwardly extending curved member of the tool holder. Each retaining member attaches a respective tool body to the respective pocket of the end of the outwardly extending curved member of the tool holder. Each cutting insert is passively rotatably disposed in the respective pocket of the end of the outwardly extending curved member of the tool holder around a different respective axis than the axis around which the tool holder is configured to rotate.

In still another embodiment, a method of using a cutting system is provided. In one step, a drive system rotates a transport member. In another step, a plurality of tool holders is passively rotated relative to the transport member. The plurality of tool holders is attached to the transport member. In an additional step, a plurality of cutting tools is passively rotated around different axis than an axis around which the respective tool holder passively rotates. The plurality of cutting tools is attached to each respective tool holder.

The scope of the present disclosure is defined solely by the appended claims and is not affected by the statements within this summary.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

Figure 1:
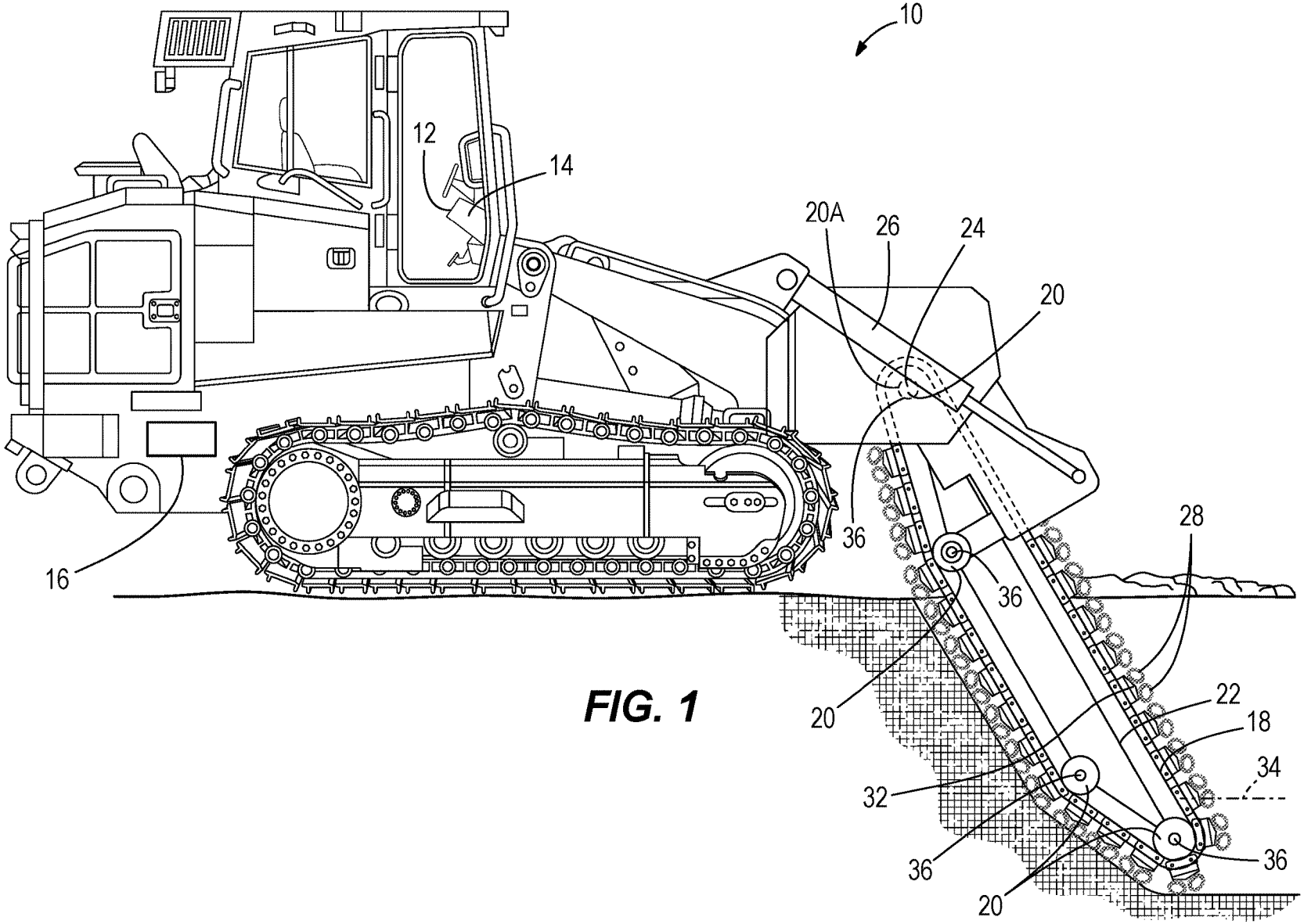
FIG. 1 illustrates a side view of a cutting system.
Figure 2:
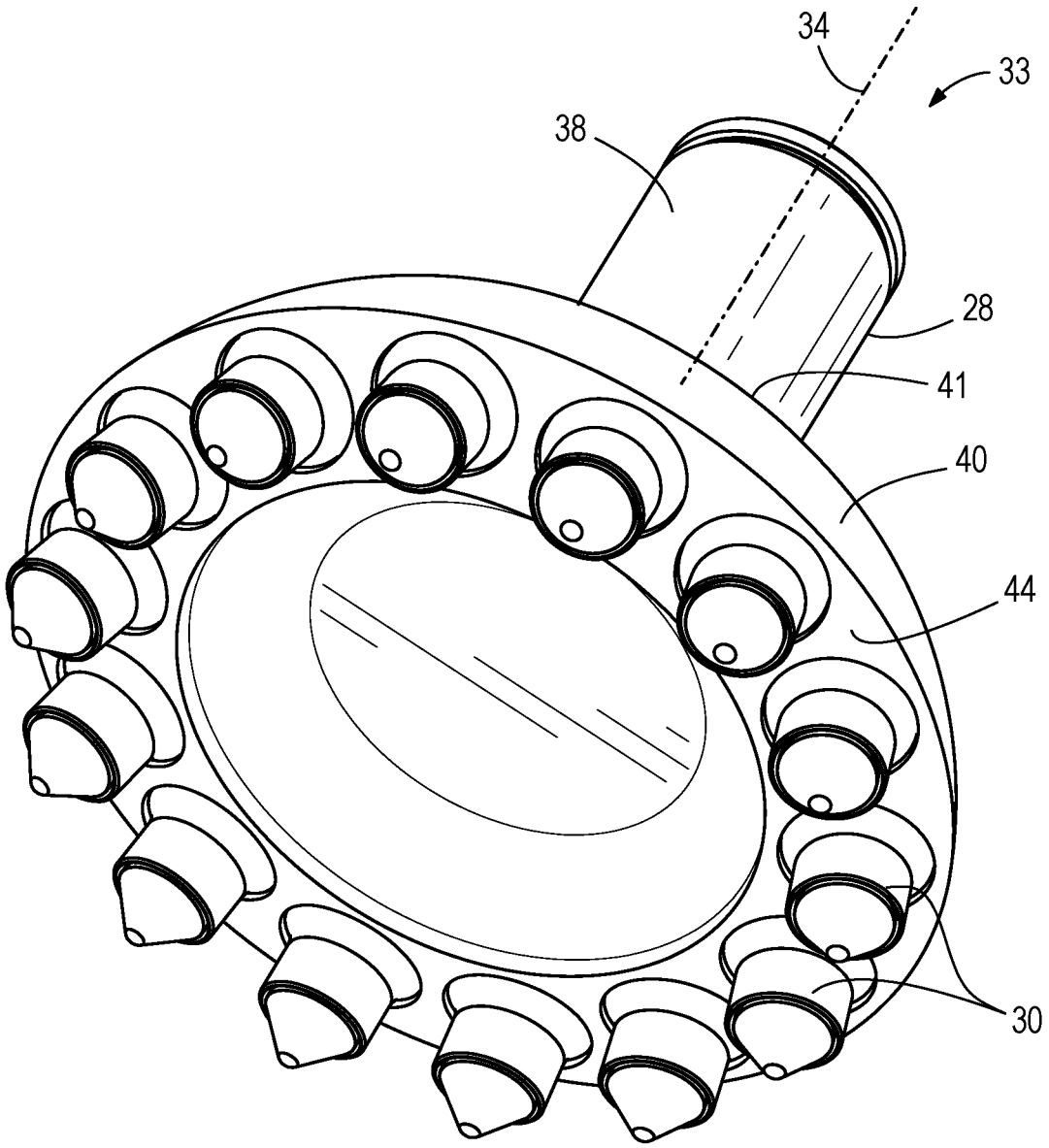
FIG. 2 illustrates a bottom perspective view of a cutting tool assembly.
Figure 3:
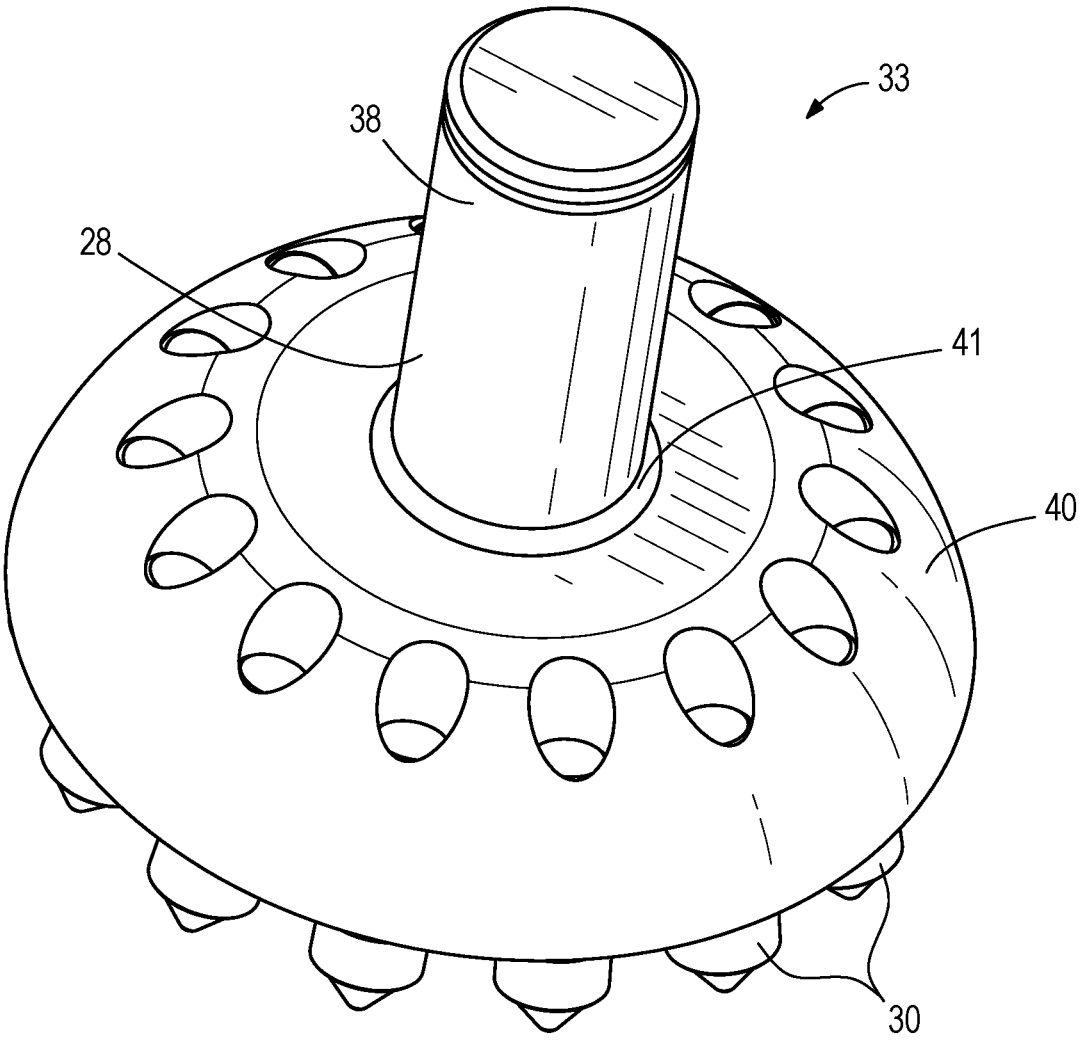
FIG. 3 illustrates a top perspective view of the cutting tool assembly of FIG. 2.
Figure 4:
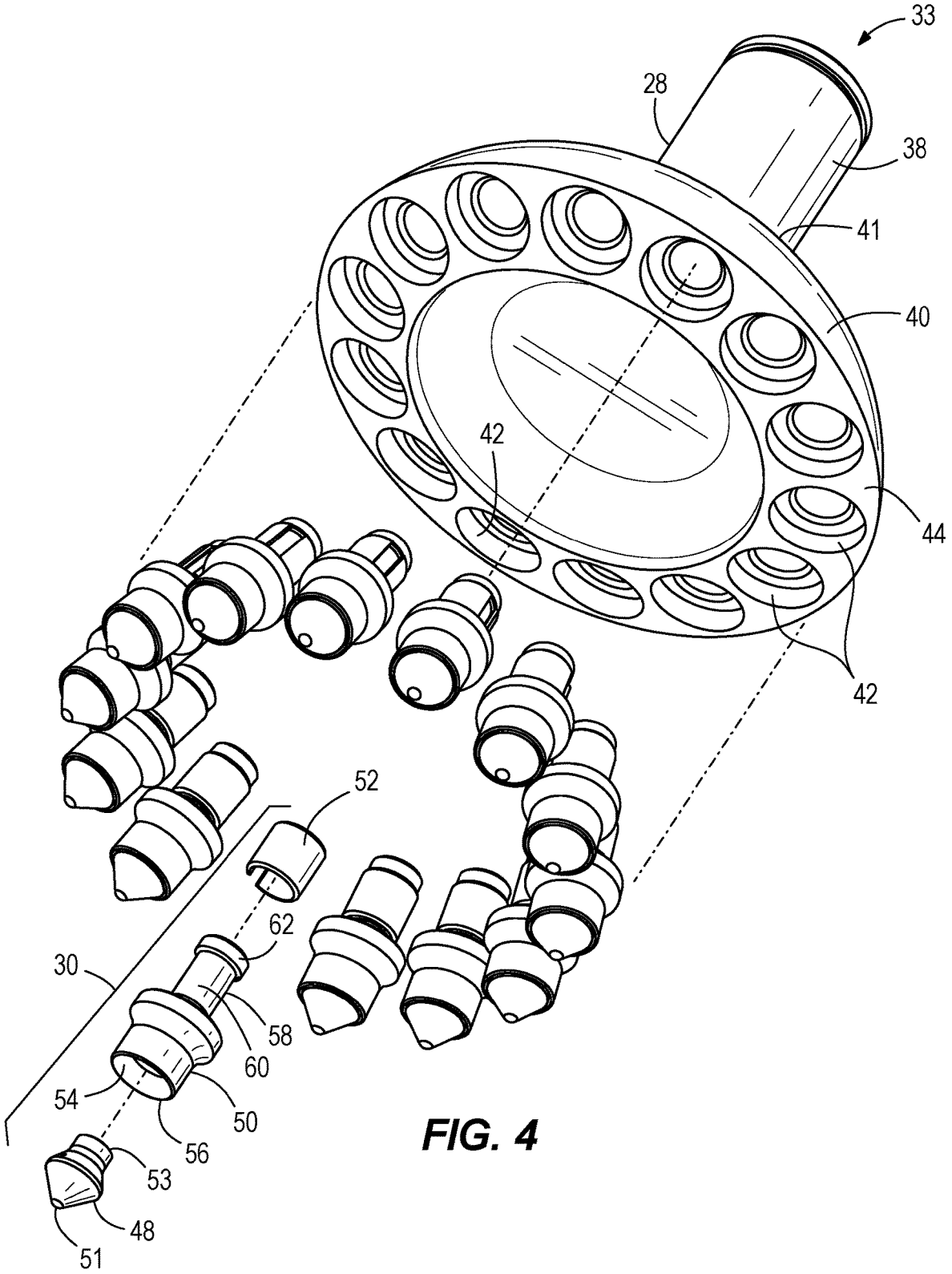
FIG. 4 illustrates the same bottom perspective view of the cutting tool assembly of FIG. 2 with the cutting tools disassembled from the cutting tool assembly.
Figure 5:
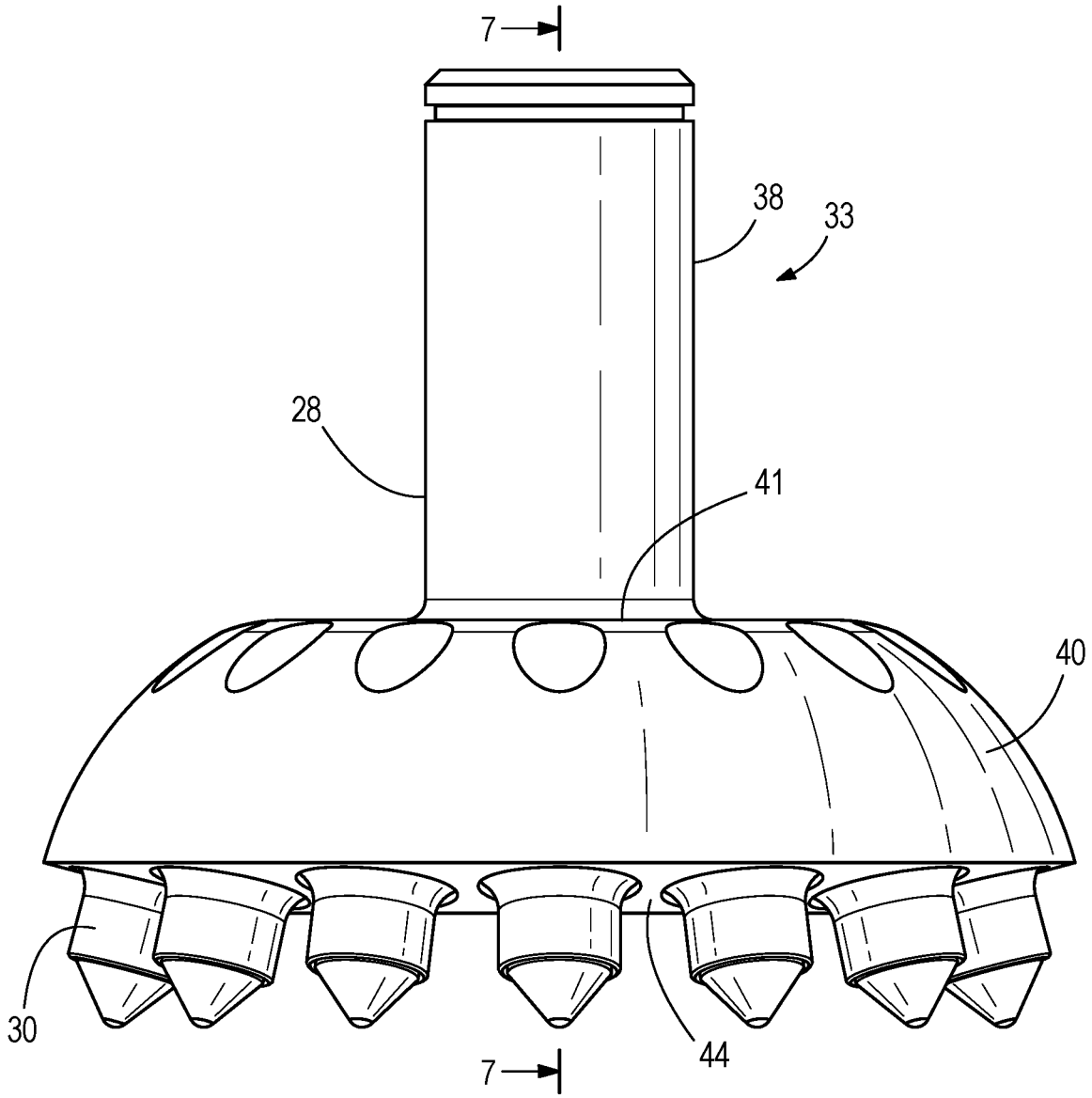
FIG. 5 illustrates a side view of the cutting tool assembly of FIG. 2.
Figure 6:
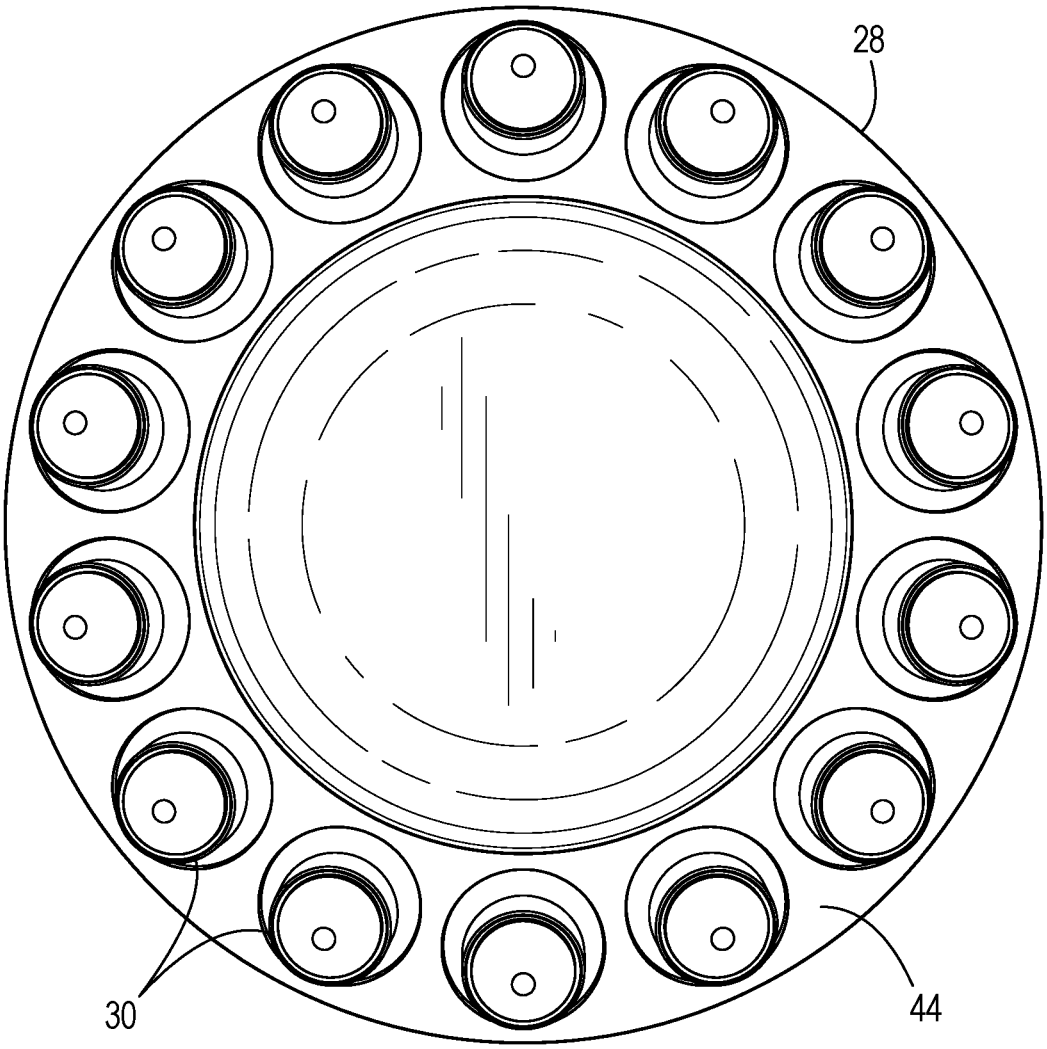
FIG. 6 illustrates a bottom view of the cutting tool assembly of FIG. 2.
Figure 7:
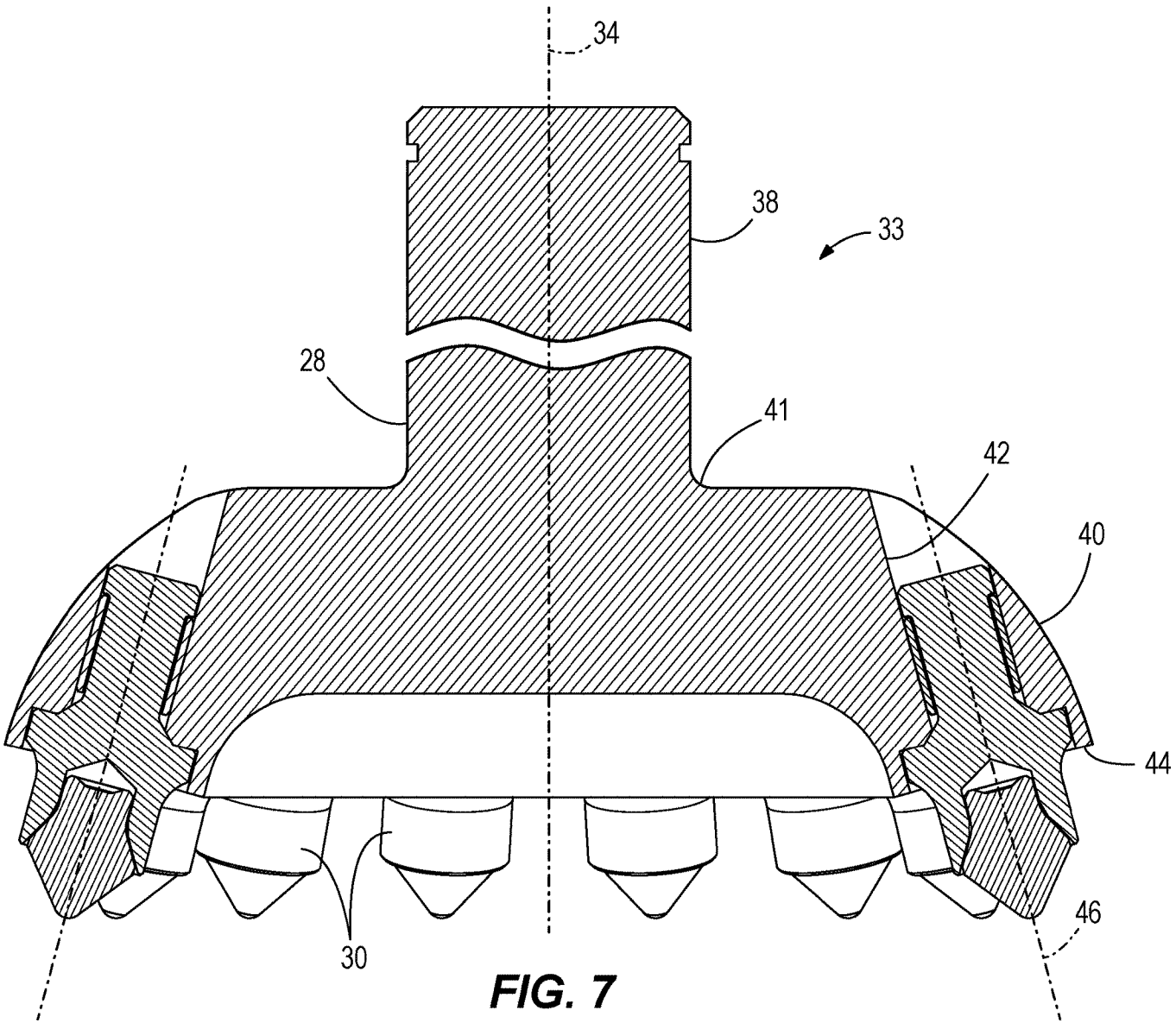
FIG. 7 illustrates a cross-section view along line 7-7 of the cutting tool assembly of FIG. 5.

As shown collectively in FIGS. 1-2, in one embodiment a cutting system 10 may be disclosed comprising the components described below. The cutting system 10 may comprise an earth cutting system, a trencher, or another type of cutting system. The cutting system 10 may comprise an input system 12, a processor 14, a motor 16, a rotatable transport member 18, a plurality of sprockets 20, a boom 22, a shaft 24, a moving member 26, a plurality of tool holders 28, a plurality of cutting tools 30, and connection systems 32. In other embodiments, the cutting system 10 may vary. The cutting system 10 may include a plurality of cutting assemblies 33 each comprising a tool holder 28 with a plurality of respective cutting tools 30 attached.

The rotatable transport member 18 may comprise a driven member such as a driven endless belt. In other embodiments, the rotatable transport member 18 may vary. The rotatable transport member 18 may be driven by the motor 16 controlled by the processor 14 in communication with the input system 12. A user may enter instructions through the input system 12 to control movement of the rotatable transport member 18 through the processor 14. The rotatable transport member 18 may rotate around the plurality of sprockets 20. Sprocket 20A, controlled by the processor 14, may drive the rotatable transport member 18 to rotate around the plurality of sprockets 20. The boom 22, pivoted on the shaft 24, may be connected with the plurality of sprockets 20. The boom 22, and the attached plurality of sprockets 20, may be raised and lowered using the moving member 26 controlled by the processor 14. The moving member 26 may comprise a hydraulic cylinder. In other embodiments, the moving member 26 may vary.

The plurality of tool holders 28 may be attached with the connection systems 32 in spaced-apart formation to and along the rotatable transport member 18. The connection systems 32 may allow each of the plurality of tool holders 28 to passively rotate relative to the rotatable transport member 18 around their respective axis 34. The connection systems 32 may comprise bearings, shafts, or other connection systems known in the art which allow passive rotation of the plurality of tool holders 28 relative to the rotatable transport member 18. The rotatable transport member 18 may rotate around different axis 36 than the respective axis 34 which the plurality of tool holders 28 passively rotate around.

Each of the plurality of tool holders 28 may have a plurality of the cutting tools 30 rotatably attached thereto. Each of the plurality of tool holders 28 may comprise a drum 38 and a curved member 40 attached to an end 41 of the drum 38. The curved member 40 may extend outwardly from the end 41 of the drum 38. The curved member 40 may comprise a semi-spherical member. In other embodiments, the curved member 40 may vary. A plurality of pockets 42 may be disposed in spaced-apart formation around an end 44 of the curved member 40. Each of the plurality of cutting tools 30 may be disposed in their own respective pocket 42 and configured to each passively rotate around their own respective axis 46. Axis 46 around which each of the respective plurality of cutting tools 30 passively rotate may be different than axis 34 around which each of the respective plurality of tool holders 28 passively rotate and different than axis 36 around which the rotatable transport member 18 rotates. Axis 46 may be disposed non-parallel to both axis 34 and axis 36. Axis 34 may be disposed non-parallel to axis 36.

Each of the plurality of cutting tools 30 may comprise a cutting insert 48, a tool body 50, and a retaining member 52. Each cutting insert 48 may comprise a cutting end 51 which is conical. In other embodiments, the cutting end 51 may vary. An opposed end 53 of each respective cutting insert 48 may be fixedly attached to and within a bore 54 at an end 56 of the respective tool body 50. This attachment may utilize brazing, an interference fit, a snap-fit, or another type of attachment. The cutting end 51 of the respective cutting insert 48 may be disposed above the bore 54 so that the cutting end 51 is exposed outside of the bore 54.

The respective retaining member 52 of each cutting tool 30 may be attached to an opposed end 58 of the respective tool body 50. The retaining member 52 may comprise a spring retaining member which is biased outwardly. In other embodiments, the retaining member 52 may vary. The opposed end 58 of the respective tool body 50 may comprise a shaft 60 having an end lip 62. The respective retaining member 52 may be disposed over the shaft 60 of the respective tool body 50 and prevented from slipping off the shaft 60 by the end lip 62. The opposed end 58 of the respective tool body 50 may be disposed within the respective pocket 42 of the end 44 of the curved member 40 of the respective tool holder 28. The respective retaining member 52 attached to the shaft 60 of the respective tool body 50 may be biased outwardly within the respective pocket 42 causing the respective retaining member 52 to abut against and be fixedly attached to and within the respective pocket 42. The shaft 60 of the respective tool body 50 and fixedly attached respective cutting insert 48 may passively rotate relative to the respective retaining member 52 and respective pocket 42.

When the rotatable transport member 18 is driven to rotate by the motor 16, the plurality of tool holders 28 passively rotate relative to the rotatable transport member 18. As this happens, each of the respective cutting tools 30 attached to each of the plurality of tool holders 28 passively rotate within and relative to their respective pockets 42 of the respective tool holders 28. Since each of the cutting tools 30 rotate around respective axis 46 which are non-parallel to the respective axis 34 around which the respective tool holders 28 rotate, friction is reduced and rotation stalling of the respective tool holders 28 and their respective cutting tools 30 is reduced. This improves the cutting efficiency of the cutting system 10 which leads to less maintenance issues and saves time and expense. Moreover, the configuration and attachment mechanism of the respective cutting tools 30 to their respective tool holders 28 allows for a damaged cutting insert 48 or a damaged cutting tool 30 to be easily and quickly replaced without having to replace other non-damaged cutting tools 30 or the respective tool holder 28 to which they are attached.

Figure 8:
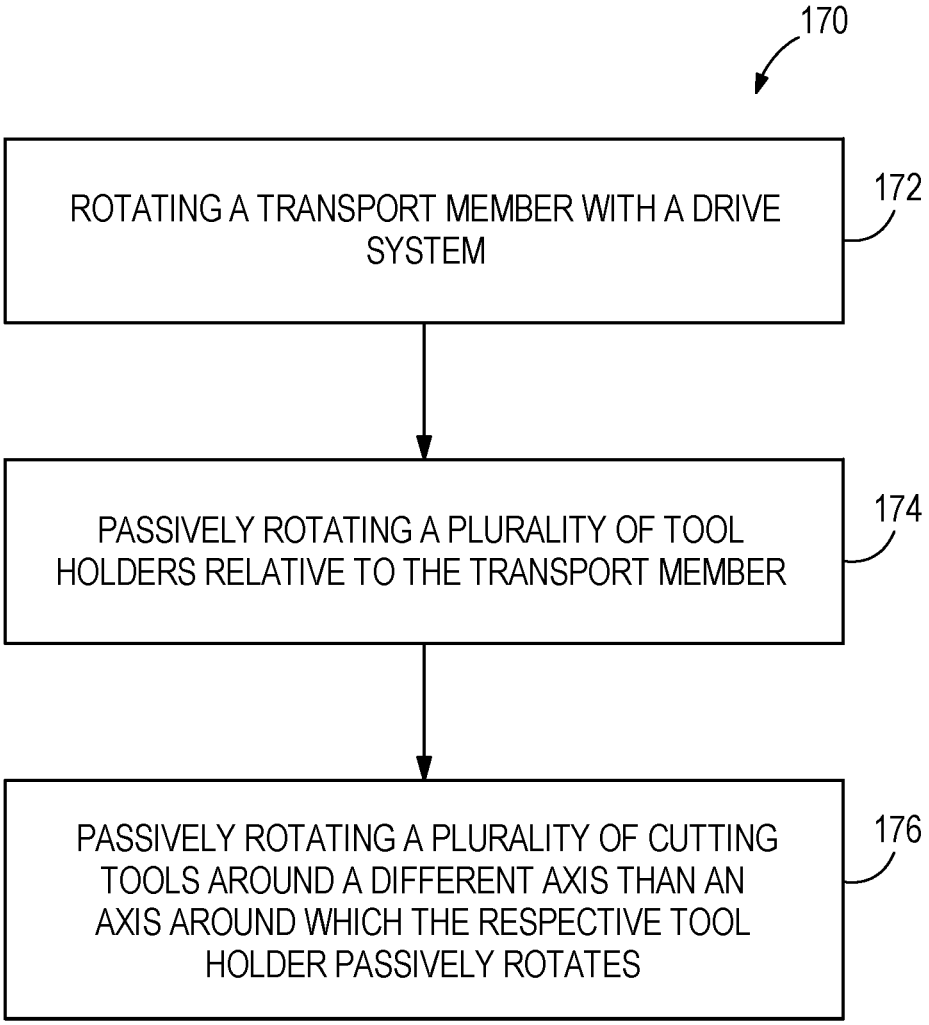
FIG. 8 is a flowchart illustrating one embodiment of a method of using a cutting system

FIG. 8 is a flowchart illustrating one embodiment of a method 170 of using a cutting system. The method 170 may use any of cutting systems or cutting assemblies disclosed herein. In other embodiments, the method 170 may utilize varying cutting system, cutting assemblies, or other systems or assemblies. In step 172, a drive system may rotate a transport member. In step 174, a plurality of tool holders may be passively rotated relative to the transport member. The plurality of tool holders may be attached to the transport member. In step 176, a plurality of cutting tools may be passively rotated around different axis than an axis around which the respective tool holder passively rotates. The axis may be non-parallel. The plurality of cutting tools may be attached to each respective tool holder.

In one embodiment, another step of the method 170 may comprise disposing a cutting insert of each respective cutting tool in a respective bore of a respective tool body of the respective cutting tool.

In another embodiment, yet another step of the method 170 may comprise disposing the tool body of each respective cutting tool within a separate respective pocket of the respective tool holder.

In still another embodiment, an additional step of the method 170 may comprise retaining the tool body of each respective cutting tool within the separate pocket of the respective tool holder with a respective retaining member of the respective cutting tool.

In still other embodiments, one or more steps of the method 170 may be altered in substance or order, one or more additional steps may be added, or one or more steps may not be followed. In additional embodiment, the method 170 may further vary.

One or more embodiments of the disclosure may reduce one or more issues associated with one or more of the existing cutting systems, existing cutting assemblies, and/or existing methods of their use. This may include, but not be limited to, reducing stalling of the tool holders and their attached cutting tools, improving cutting efficiency, reducing maintenance issues, and reducing the time and expense of replacing a damaged cutting tool. One or more additional issues associated with one or more of the existing cutting systems, existing cutting assemblies, and/or existing methods of their use may also be reduced or overcome.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true scope of the subject matter described herein. Furthermore, it is to be understood that the disclosure is defined by the appended claims. Accordingly, the disclosure is not to be restricted except in light of the appended claims and their equivalents.

The invention claimed is:

1. A cutting system comprising:

a rotatable transport member comprising a driven endless member;

a plurality of tool holders attached to the rotatable transport member, the plurality of tool holders spaced apart along the rotatable transport member and configured to passively rotate relative to the rotatable transport member; and a plurality of cutting tools rotatably attached to each tool holder, each of the cutting tools configured to passively rotate around a different respective axis than an axis around which the tool holder passively rotates, each of the plurality of cutting tools being passively rotatably attached around multiple axis.

2. The cutting system of claim 1 wherein the cutting system comprises an earth cutting system.

3. The cutting system of claim 1 wherein the rotatable transport system comprises a driven endless belt.

4. The cutting system of claim 1 wherein the rotatable transport member rotates around a different axis than the plurality of tool holders.

5. The cutting system of claim 1 wherein each tool holder comprises a drum.

6. The cutting system of claim 5 wherein each tool holder comprises an outwardly extending curved member disposed at an end of the drum.

7. The cutting system of claim 6 wherein an end of each outwardly extending curved member comprises a plurality of pockets spaced apart around the end of the outwardly extending curved member.

8. The cutting system of claim 7 wherein each of the plurality of cutting tools is rotatably disposed in a separate one of the plurality of pockets.

9. The cutting system of claim 1 wherein each cutting tool comprises a cutting insert, a tool body, and a retaining member comprising a biasing member attaching the tool body to the tool holder.

10. The cutting system of claim 9 wherein each cutting insert comprises a conical cutting insert.

11. The cutting system of claim 9 wherein the cutting insert of each cutting tool is disposed in a bore of the tool body.

12. The cutting system of claim 9 wherein the tool body of each cutting tool is retained within a separate pocket of the respective tool holder by the respective retaining member.

13. The cutting system of claim 12 wherein the retaining member of each cutting tool comprises a spring retaining member.

14. The cutting system of claim 9 wherein the respective retaining member of each cutting tool is fixed in place in and against a respective pocket of the associated tool holder, a bottom end of the respective retaining member abutting against a portion of an end of the respective tool body preventing the respective tool body from coming out of the respective pocket, the portion disposed below the bottom end of the respective retaining member in the respective pocket.

15. A cutting assembly comprising:

a tool holder comprising a drum and an outwardly extending curved member disposed at an end of the drum, an end of the outwardly extending curved member comprising a plurality of pockets spaced apart around the end of the outwardly extending curved member, the tool holder configured to rotate around an axis; and a plurality of cutting tools, each cutting tool comprising a cutting insert, a tool body, and a retaining member;

wherein each cutting insert is disposed in a bore of a respective tool body, each tool body is disposed in a respective pocket of the end of the outwardly extending curved member of the tool holder, each retaining member attaches a respective tool body to the respective pocket of the end of the outwardly extending curved member of the tool holder, and each cutting insert is passively rotatably disposed in the respective pocket of the end of the outwardly extending curved member of the tool holder around a different respective axis than the axis around which the tool holder is configured to rotate, each of the plurality of cutting tools being passively rotatably attached around multiple axis.

16. The cutting system of claim 15 wherein each cutting insert comprises a conical cutting insert.

17. The cutting system of claim 15 wherein the retaining member of each cutting tool comprises a spring retaining member.

18. A method of using a cutting system comprising:

rotating a transport member, comprising an endless belt, with a drive system comprising a motor;

passively rotating a plurality of tool holders, attached to the transport member, relative to the transport member; and passively rotating a plurality of cutting tools, attached to each respective tool holder, around different respective axis than an axis around which the respective tool holder passively rotates, so that each of the plurality of cutting tools passively rotates around multiple respective axis.

19. The method of claim 18 further comprising disposing a cutting insert of each respective cutting tool in a respective bore of a respective tool body of the respective cutting tool.

20. The method of claim 19 further comprising disposing the tool body of each respective cutting tool within a separate pocket of the respective tool holder.

21. The method of claim 20 further comprising retaining the tool body of each respective cutting tool within the separate pocket of the respective tool holder with a respective retaining member, comprising a biasing member, of the respective cutting tool.

* * * * *